US010634348B2

(12) United States Patent
Kashihara et al.

(10) Patent No.: US 10,634,348 B2
(45) Date of Patent: Apr. 28, 2020

(54) COMBUSTION APPARATUS OVERHEATING DEVICE

(71) Applicant: NORITZ CORPORATION, Hyogo (JP)

(72) Inventors: Yasushi Kashihara, Hyogo (JP); Kengo Horiuchi, Hyogo (JP); Toshihiko Hamagami, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 442 days.

(21) Appl. No.: 15/149,265

(22) Filed: May 9, 2016

(65) Prior Publication Data

US 2016/0341424 A1 Nov. 24, 2016

(30) Foreign Application Priority Data

May 22, 2015 (JP) ..... 2015-104164

(51) Int. Cl.
*F23N 5/24* (2006.01)
*F23M 11/00* (2006.01)

(52) U.S. Cl.
CPC ..... *F23N 5/245* (2013.01); *F23M 11/00* (2013.01); *F23N 5/24* (2013.01)

(58) Field of Classification Search
USPC ..... 431/16, 21, 22; 126/287.5
See application file for complete search history.

(56) References Cited

U.S. PATENT DOCUMENTS 2,538,492 A * 1/1951 Anderson ..... B61D 27/0063 126/93
2,764,025 A * 9/1956 Otto ..... H01H 37/76 337/404
3,377,448 A * 4/1968 Baumbach ..... H01H 37/761 337/166
3,633,600 A * 1/1972 Sadamori ..... C10M 135/32 126/287.5
3,672,386 A * 6/1972 Mochida ..... F16K 17/40 126/287.5
4,044,727 A * 8/1977 Rychen ..... F23B 1/38 122/249

(Continued)

FOREIGN PATENT DOCUMENTS

JP 3792326 B2 7/2006
JP 2011-069582 A 4/2011
JP 2013234821 A 11/2013

*Primary Examiner* — Avinash A Savani
(74) *Attorney, Agent, or Firm* — Studebaker & Brackett PC

(57) ABSTRACT

Spread of leaking combustion exhaust or the like is suppressed and a thermal fuse is made to operate in definitive fashion. A back flange is made to protrude so as to be directed toward a rear wall of an outer casing from a joint between a combustor casing and a heat exchanger casing to a location in the vicinity of the rear wall. A thermal fuse is arranged about the periphery of the heat exchanger casing so as to extend along a region near a protruding end edge of the back flange. The back flange is provided with a through hole, and combustion exhaust which leaks from the combustor casing is guided to the thermal fuse. A back flange which is similar thereto is installed at an upper location so as to straddle a tubing elbow. The two flanges are made to protrude beyond the tubing elbow.

7 Claims, 8 Drawing Sheets

(56) References Cited

U.S. PATENT DOCUMENTS

| | | | | | |
|---|---|---|---|---|---|
| 4,089,632 | A | * | 5/1978 | Rexroad | F23N 5/107<br>136/242 |
| 4,417,869 | A | * | 11/1983 | Copenhaver | F23D 14/72<br>200/61.08 |
| 4,437,829 | A | * | 3/1984 | Baker | F23N 5/245<br>122/504 |

* cited by examiner

COMBUSTION APPARATUS OVERHEATING DEVICE

PRIORITY CLAIM AND INCORPORATION BY REFERENCE

This application claims benefit of priority under 35 USC 119(a)-(d) to Japanese Patent Application No. 2015-104164, entitled "Combustion Apparatus", filed 22 May 2015, the content of which is incorporated herein in its entirety by reference.

BACKGROUND

The present invention relates to a combustion apparatus for heating by means of combustion.

A combustion apparatus may be equipped with overheating prevention device(s) employing any of various types of thermal fuse(s). One such overheating prevention device may force termination of combustion when heat impinging thereon results in ablation of a portion thereof and causes what had been electrical continuity to become an electrical open.

A combustion apparatus may have an outer casing. A heat exchanger may be installed within this outer casing. This heat exchanger may have a casing. The combustion apparatus may be such that an upper portion of a rear space, rearward from the heat exchanger casing and between the heat exchanger casing and the outer casing, is occluded. The combustion apparatus may be such that through hole(s) are provided only centrally in a horizontal direction. The combustion apparatus may be such that thermal fuse(s) are provided at location(s) below such through hole(s). With such a combustion apparatus, it will be possible to cause hot air in the aforementioned rear space to be guided so as to flow toward central through hole(s) such that the hot air goes past thermal fuse(s) as that hot air flows through through-hole(s).

Alternatively or in addition thereto, hot water supply line tubing may be wrapped about periphery or peripheries of heat exchanger casing(s). Thermal fuse(s) may be arranged beneath such hot water supply line tubing. Cover(s) may cover hot water supply line tubing and thermal fuse(s).

Alternatively or in addition thereto, water feed tubing may be wrapped about the periphery or peripheries of combustor casing(s). There may be combustion burner(s) within the combustor casing(s). Hose clamp(s) or the like may be used to attach water feed tubing to combustor casing(s). End(s) extending from hose clamp(s) may be bent. Thermal fuse(s) may be supported by such bent end(s) of hose clamp(s) so that the thermal fuse(s) are removed by some distance(s) from combustor casing(s).

SUMMARY OF INVENTION

However, to cause proper operation of overheating prevention device(s) and achieve definitive prevention of overheating, e.g., to cause heat from leaking combustion exhaust or the like to act on overheating prevention device(s) in effective fashion, ingenuity is required with respect to arrangement of overheating prevention device(s). However, due to the structure of heat exchanger(s) and so forth, space(s) of considerable width(s) may be present between outside surface(s) of combustor casing and inside surface(s) of outer casing of the combustion apparatus. Where this is the case, spreading of leaking combustion exhaust will make it difficult to cause the heat from the leaking combustion exhaust to act on overheating prevention device(s) in effective and rapid fashion.

For this reason, it is a technical problem in the context of combustion apparatuss to suppress the spreading of leaking combustion exhaust or the like and to make it possible for overheating prevention device(s) to operate in definitive fashion.

The subject of the present invention is a combustion apparatus as described below. That is, such a combustion apparatus may comprise an outer casing having a rear wall for attachment to an attachment wall to which the combustion apparatus is attached. Such a combustion apparatus may further comprise an inner casing extending in a vertical direction and constituting a combustor and a heat exchanger unit. The inner casing may be housed within the outer casing. An inside surface of the rear wall and a back wall of the inner casing may be mutually opposed and spaced apart in a front-to-back direction so as to produce an interspace region therebetween. In addition, a combustion apparatus in accordance with one embodiment of the present invention may be provided with the following technical means.

That is, such a combustion apparatus may further comprise a first flange that protrudes so as to be directed toward the rear wall of the outer casing from a back wall of the inner casing at a region in a boundary between the combustor and the heat exchanger unit to a location in a vicinity of the rear wall. Such a combustion apparatus may further comprise an overheating prevention device that is arranged on the first flange and that is configured so as to operate when heat of a prescribed temperature or higher impinges thereon. In addition, a through hole that penetrates the first flange in the vertical direction may be formed at the first flange at a location thereon which is near the overheating prevention device.

The combustion apparatus in accordance with one embodiment of the present invention is such that the first flange causes an interspace region between the inside surface of the rear wall and the back wall of the inner casing to be partitioned into upper and lower portions. For this reason, even if combustion exhaust leaks from the heat exchanger casing, such leaking combustion exhaust will be prevented from spreading therebelow, and it will be possible to cause heat to act on the overheating prevention device in effective fashion. Furthermore, even if combustion exhaust leaks from the combustor casing, such leaking combustion exhaust will flow through the through hole. For this reason, it will be possible to cause heat from such leaking combustion exhaust to act in effective fashion on the overheating prevention device which is disposed at a location near the through hole. This will make it possible to cause the overheating prevention device to operate quickly and definitively, and will make it possible to achieve prevention of overheating.

Other embodiments, systems, methods, and features, and advantages of the present invention will be or become apparent to one with skill in the art upon examination of the following drawings and detailed description. It is intended that all such additional systems, methods, features, and advantages are included within this description, are within the scope of the present invention, and are protected by the accompanying claims.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

In accordance with some embodiments of the present invention, overheating prevention device(s) may be arranged at location(s) near protruding end edge(s) of first flange(s). Where this is the case, it will be possible to cause overheating prevention device(s) to properly reflect thermal situation(s) at location(s) near rear wall(s) of outer casing(s), and it will be possible to cause wall(s) where the combustion apparatus is installed to definitively and preemptively be prevented from experiencing overheated condition(s).

In some embodiments of the present invention, heat exchanger unit(s) may further comprise tubing elbow(s). Such tubing elbow(s) may protrude so as to be directed toward rear wall(s) of the outer casing from back wall(s) of the inner casing(s). In some embodiments, heat exchanger unit(s) may further comprise second flange(s). Such second flange(s) may protrude, so as to be directed toward rear wall(s) the outer casing, from back wall(s) of the inner casing(s) at location(s) above first flange(s), such that at least a portion of the tubing elbow(s) is disposed between at least a portion of the first flange(s) and at least a portion of the second flange(s), to location(s) near rear wall(s) of the outer casing. Where this is the case, it will be possible to cause interspace region(s) between rear wall(s) of the outer casing and back wall(s) of the inner casing of heat exchanger unit(s) to be partitioned into upper and lower portions, and in the unlikely event that there is presence of leaking combustion exhaust it will be possible to cause such leaking combustion exhaust to fill such space(s) partitioned into upper and lower portions. This will make it possible to cause overheating prevention device(s) to operate in more definitive fashion.

Moreover, protruding end(s) of at least a portion of the first flange(s) and protruding end(s) of at least a portion of the second flange(s) may be made to protrude so as to extend to location(s) nearer rear wall(s) of the outer casing than protruding end(s) of tubing elbow(s). Where this is the case, it will be possible to prevent occurrence of damage to tubing elbow(s) even when the combustion apparatus on which combustor unit(s) and heat exchanger unit(s) have been installed is temporarily made to lie on its side such that back wall(s) of the inner casing are downwardly directed.

Below, embodiments of the present invention are described in detail with reference to the drawings.

Figure 1:
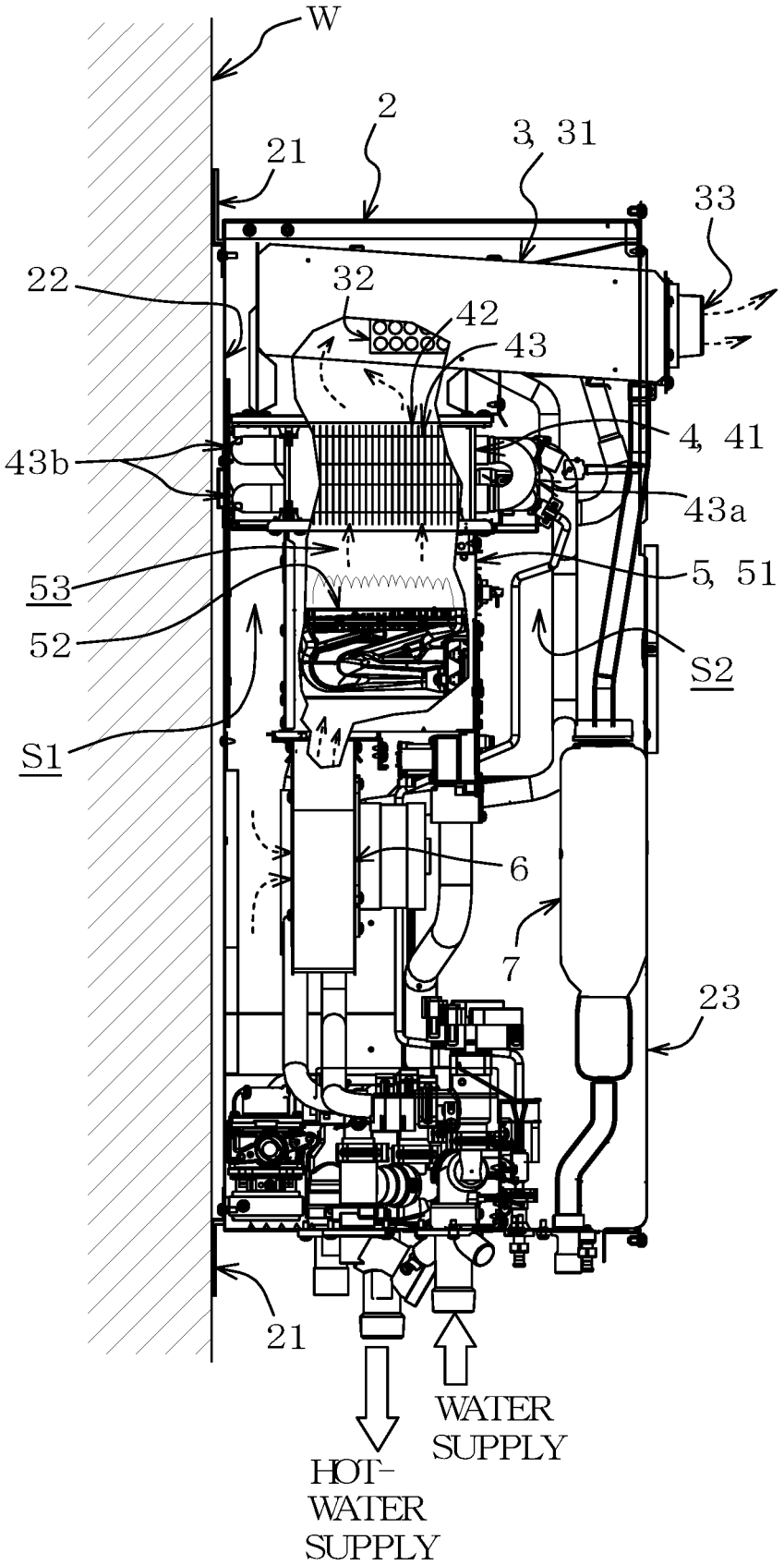
FIG. 1 is a side view of a situation in which a side wall of an outer casing of a combustion apparatus has been removed to reveal the interior thereof.

FIG. 1 is a combustion apparatus associated with an embodiment of the present invention. This combustion apparatus is provided with overheating prevention device(s) (e.g., a thermal fuse) primarily for protecting installation wall(s) (e.g., a wooden wall in a residential building) W at which this combustion apparatus is installed. Overheating prevention devices are devices for forcing termination of operation of combustion apparatus(s). The combustion apparatus is equipped with overheating prevention device(s) so that, in the event that there is leakage of combustion exhaust and/or combustion gas from the interior as a result of occurrence of damage to (e.g., puncture of) heat exchanger casing(s) 41 or the like, the aforementioned installation wall(s) W can be prevented from experiencing an overheated condition due to heat from such leaking combustion exhaust and/or combustion gas.

Outer casing(s) 2 of combustion apparatus(s) are secured to installation wall(s) W by means of bracket(s) 21. Provided at the interior of outer casing 2, in order from the uppermost thereamong, are: secondary heat exchanger(s) 3 for recovery of latent heat; primary heat exchanger(s) 4 for recovery of sensible heat; combustor(s) 5; and blower fan(s) 6. Combustor 5 serving as combustor unit may be equipped with a plurality of combustion burners 52 housed within lower portion(s) of combustor casing(s) 51. The plurality of combustion burners 52 are supplied with combustion air by blower fan(s) 6 therebelow, and combustion takes place at combustion chamber(s) 53.

Primary heat exchanger 4 serving as heat exchanger unit is constituted in finned tube fashion from a multiplicity of fins 42 housed within heat exchanger casing 41, and from a plurality of water tubes 43 for receiving heat which penetrates these fins 42. Water tubes 43 are connected so as to permit communication therebetween by tubing elbows 43*a*, 43*b* which protrude toward the front and back from the front and back surfaces (surfaces at left and right in FIG. 1) of heat exchanger casing 41, permitting formation of a single flow path for exchange of heat. In addition, water within water tubes 43 may be heated by exchange of heat from combustion gas(es) from combustion chamber(s) 53.

Secondary heat exchanger 3 may, for example, be equipped with shell-and-tube-type heat exchanger(s) 32 housed within heat exchanger casing(s) 31 which also serve as exhaust stack(s). This secondary heat exchanger 3 preheats the interior of the flow path by recovering latent heat from combustion exhaust that has passed through primary heat exchanger 4. Water fed thereto by water feed tubing is first preheated when it is made to pass through secondary heat exchanger 3, and is thereafter heated to prescribed temperature when it is made to pass through primary heat exchanger 4. The hot water produced by such heating is directed to hot water feed tubing and is thereafter guided to a hot water tap, not shown. Recovery of latent heat at secondary heat exchanger 3 causes cooling of combustion exhaust, as a result of which there is production of combustion exhaust condensate. This combustion exhaust condensate collects at neutralization tank(s) or other such treatment tank(s) 7, and is discharged following the neutralization or other such treatment that is carried out at treatment tank(s) 7.

Tubing elbows 43*a*, 43*b* protrude toward the front and back from heat exchanger casing 41 of primary heat exchanger 4. Secondary heat exchanger 3, being comparatively long in the front-to-back direction, protrudes beyond the front of primary heat exchanger 4 and the front of combustor 5. In addition, exhaust outlet 33 at the front face of secondary heat exchanger 3 is exposed such that it is not hidden by the front wall of outer casing 2. As a result of the foregoing, interspace region(s) S1 which are comparatively wide, being of inside width(s) corresponding to length(s) by which tubing elbow(s) 43*b* protrude, are formed between the inside surface of rear wall 22 of outer casing 2 and the back surfaces (the surfaces at left in FIG. 1 through FIG. 3) of heat exchanger casing 41 and combustor casing 51.

In addition, interspace region(s) S2 which are quite wide, being of inside width(s) corresponding to length(s) by which secondary heat exchanger 3 protrudes beyond length(s) by which tubing elbow(s) 43*a* protrude, are formed between the inside surface of front wall 23 of outer casing 2 and the front surfaces (the surfaces at right in FIG. 1 through FIG. 3) of heat exchanger casing 41 and combustor casing 51. On the other hand, the interspace regions between the inside surfaces of the walls at the two sides of outer casing 2 and the two sides of heat exchanger casing 41 and combustor casing 51 are such that one is exceedingly small and the other is nonexistent except as required for routing of connecting water tubing.

Combustor casing 51 and heat exchanger casing 41 have respective horizontal cross-sections that are rectangular and that are of approximately mutually equal size; are formed in angular trunk-like fashion such that the top and bottom surfaces thereof are open; and are mutually joined in the vertical direction. Furthermore, connecting stack 34 protrudes upwardly from heat exchanger casing 41, being connected with heat exchanger casing 41 in the vertical direction. An opening at the bottom of connecting stack 34 is formed so as to have a shape and size corresponding to an opening at the top of heat exchanger casing 41. In addition, formed at the joint between combustor casing 51 and heat exchanger casing 41 are front flange 8 which protrudes toward the front, and back flange (first flange) 9 (e.g., see FIG. 3) which protrudes toward the back.

Formed at the joint between heat exchanger casing 41 and connecting stack 34 is back flange (second flange) 10 which has a protruding length that is equivalent to that of back flange 9. The two, i.e., upper and lower, back flanges 9, 10 (e.g., see FIG. 4) are arranged such that their tips are respectively disposed at locations which are rearward (at locations toward rear wall 22) from protruding end(s) of tubing elbow(s) 43*b*, such that although they do not come in contact with the inside surface of rear wall 22 of outer casing 2, they protrude to locations that almost coincide with the inside surface of rear wall 22. In other words, the protruding ends of back flanges 9, 10 extend to locations in the vicinity of, and removed by only a very small distance from, the inside surface of rear wall 22 (the inside surface of heat shield 24). As a result, these back flanges 9, 10 cause nearly the entirety in the front-to-back direction of rearward interspace region S1 to be partitioned and divided into upper and lower portions. Furthermore, formed at back flange 9, which is the lower of the two, is one through hole 93, or a plurality of through holes 93 separated by appropriate distance(s) in the left-to-right direction, that penetrate back flange 9 in the vertical direction (see also FIG. 5).

Figure 6:
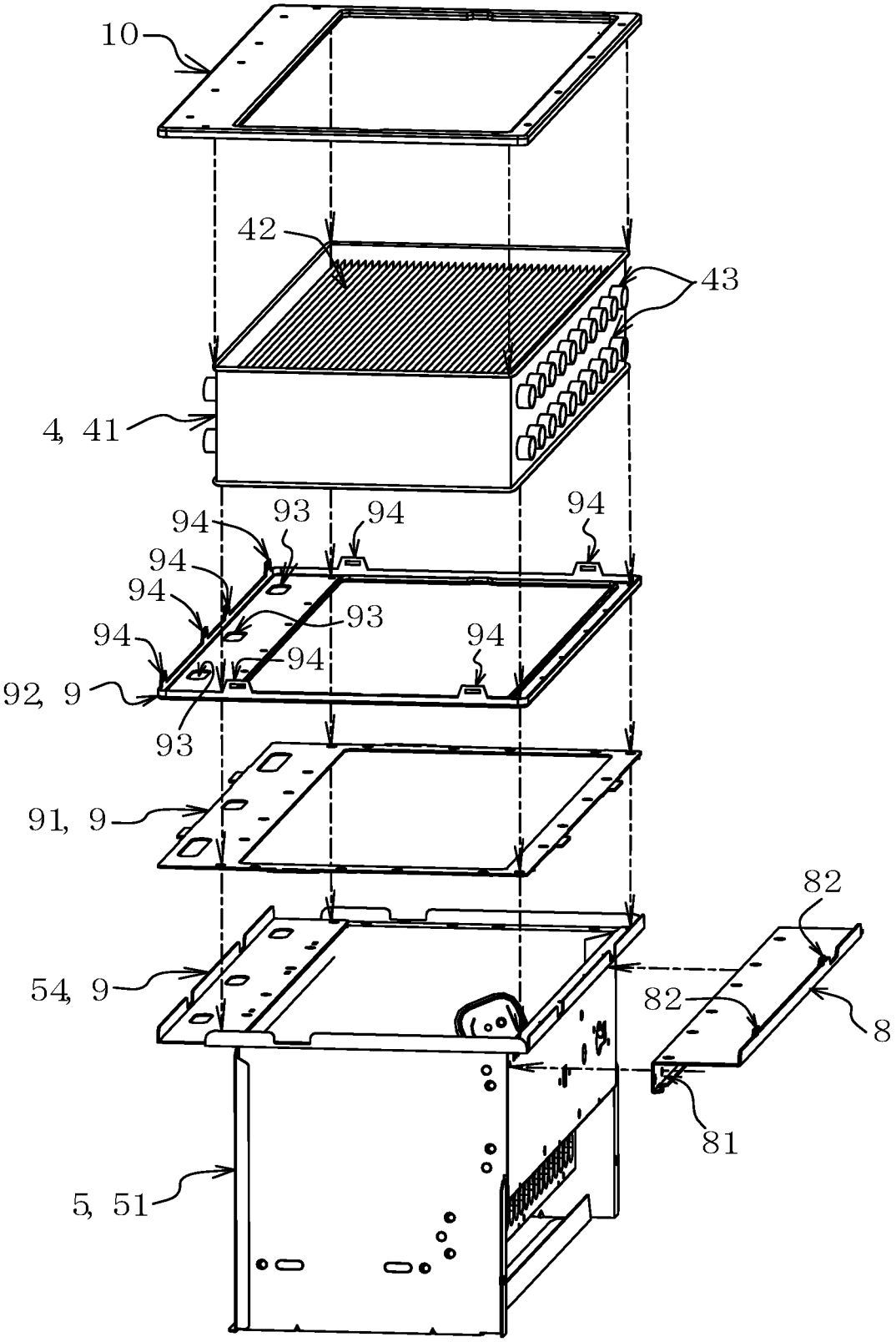
FIG. 6 is an exploded perspective view showing the situation that exists when a combustor casing, a heat exchanger casing, and so forth are disassembled.

Front flange 8 and back flanges 9, 10 may be formed so as to be integral with combustor casing 51 and/or heat exchanger casing 41, or may be formed so as to be separate from combustor casing 51 and/or heat exchanger casing 41. For example, as shown in FIG. 6, a flange 54 might be formed about the periphery of the opening at the top of combustor casing 51, and a gasket 91 and a flange 92 having dimensions similar to those of this flange 54 might be placed thereover such that these are sandwiched therewithin when heat exchanger casing 41 is coupled thereto, to form back flange 9. Through holes are formed at respectively identical locations in flange 54, gasket 91, and flange 92, placement of flange 54, gasket 91, and flange 92 one atop the other causing formation of the aforementioned plurality of through holes 93. Furthermore, in the example at FIG. 6, the portion corresponding to front flange 8 is not formed in integral fashion, but rather front flange 8 is formed so as to be an independent member, the proximal end 81 of front flange 8 being secured to the front wall of combustor casing 51. Moreover, back flange 10 is also formed so as to be an independent member, this back flange 10 being such that it is sandwiched between heat exchanger casing 41 and connecting stack 34.

Figure 7A:
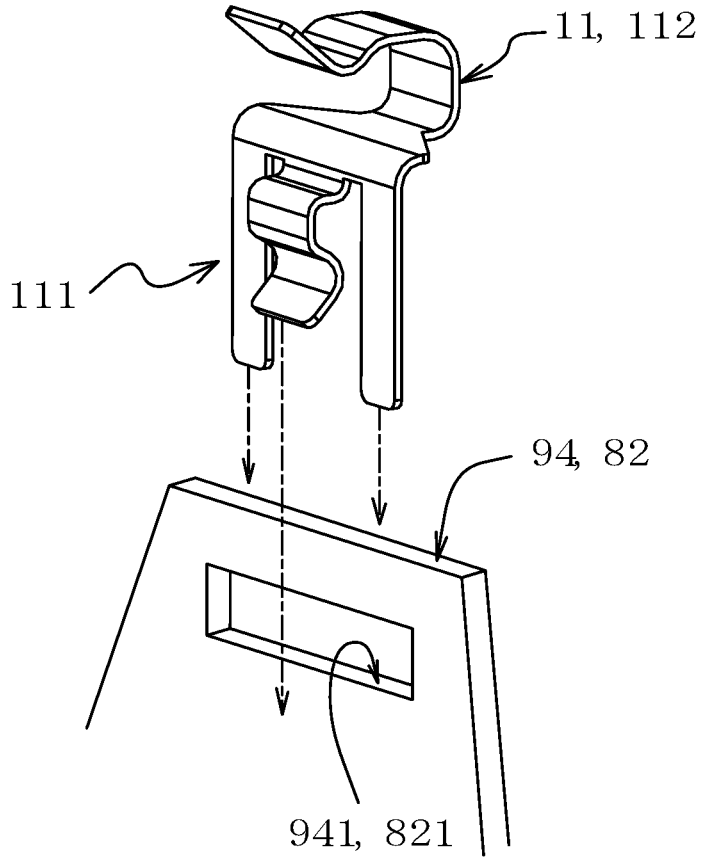
FIG. 7A is an exploded perspective view showing the situation that exists where a fastener is installed.
Figure 7B:
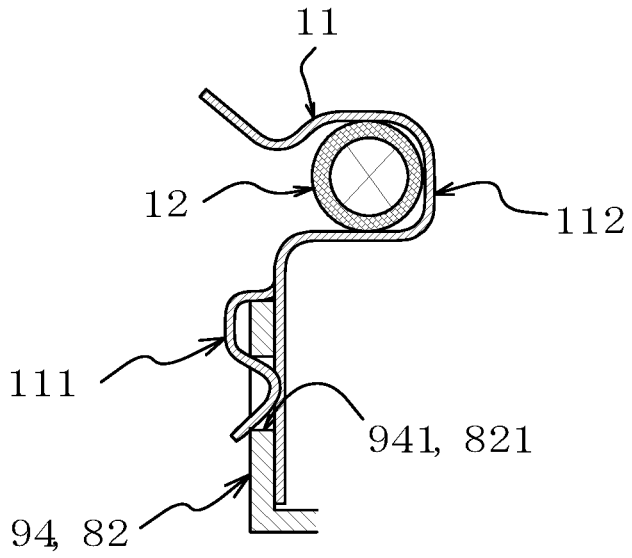
FIG. 7B is a sectional view corresponding to section B-B in FIG. 4 but from which some portions have been omitted, this sectional view showing the situation that exists when a thermal fuse is supported by a fastener that is installed thereat.

Protruding upward from the edge at the protruding back end of, and from the edges at either side of, back flange 92 are a plurality of attachment tabs 94, 94, . . . which are spaced apart at appropriate interval(s) (see FIG. 6); similarly, protruding upward from the front edge of front flange 8 are a plurality of attachment tabs 82, 82, . . . which are spaced apart at appropriate interval(s). In addition, at respective attachment tabs 94, 82, thermal fuse (overheating prevention device) 12 is supported by way of fastener members 11 (see FIG. 2 through FIG. 5). As shown by way of example at FIG. 7, fastener member 11 is provided with an upper fastener portion 112 above a lower clip portion 111. By engaging these fastener members 11 with attachment tabs 94, 82 from above, it is possible to securely locate fastener members 11 at attachment holes 941, 821. In addition, by pressing thermal fuse 12 into fastener portions 112, it is possible to cause thermal fuse 12 to be supported in removably attached fashion. Such effects are due to the elastically deformable and/or elastically resilient capabilities that the fastener members 11 possess. Note that fastener(s) or other such member(s) of any other suitable configuration may be employed as means for supporting thermal fuse(s) 12.

Figure 2:
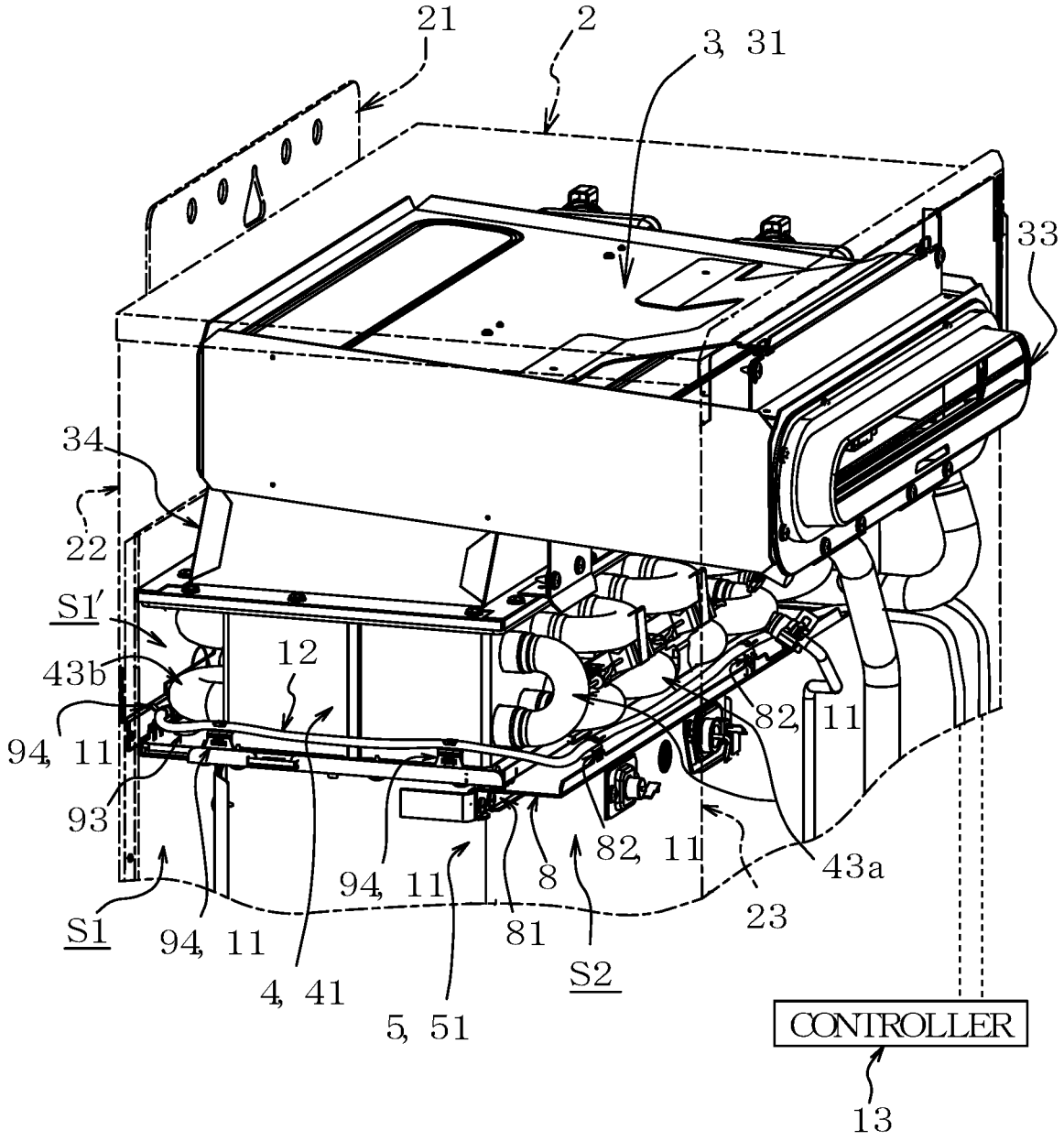
FIG. 2 is an enlarged partial perspective view showing the upper half of a combustion apparatus.
Figure 3:
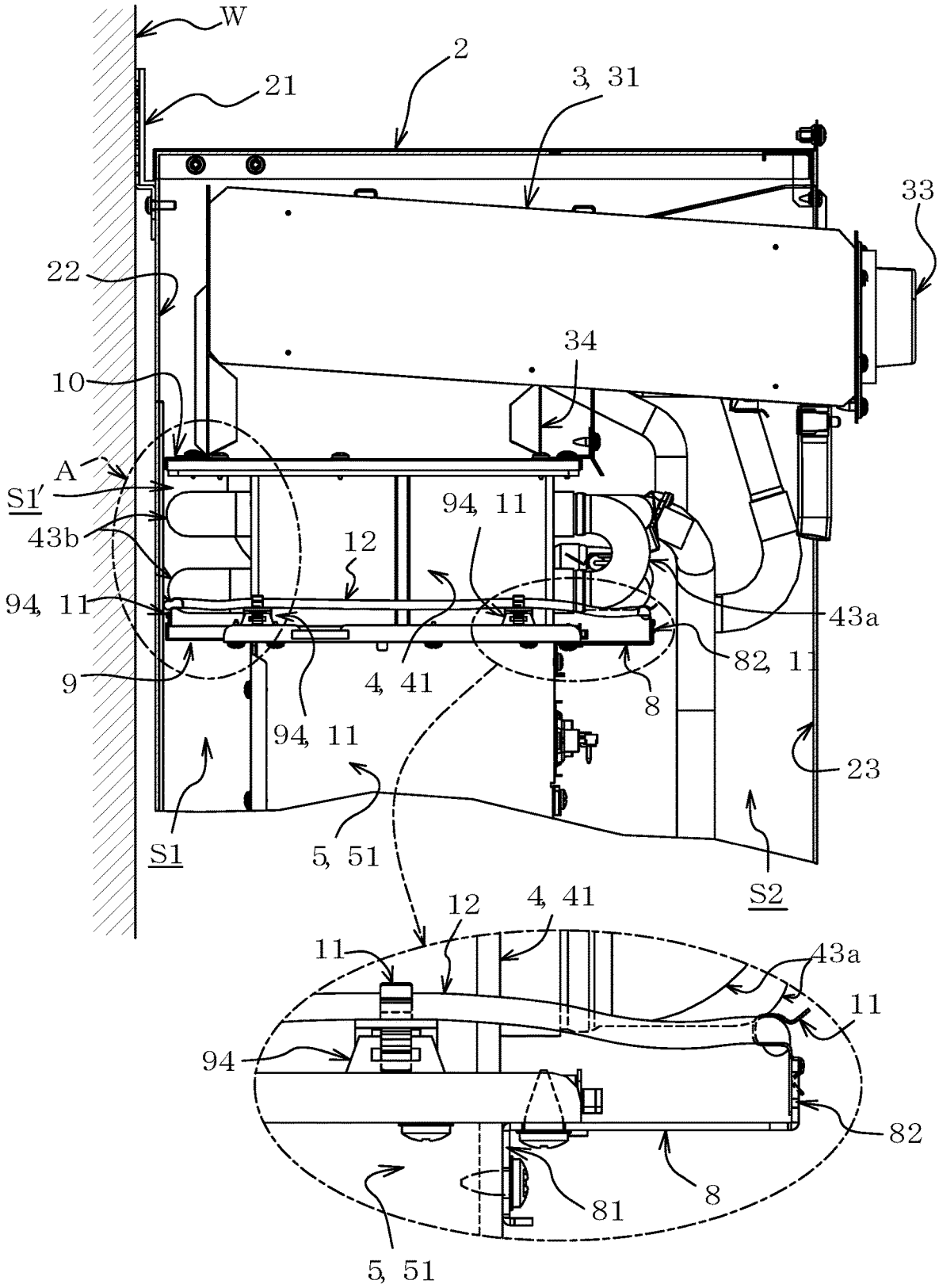
FIG. 3 is an enlarged partial view showing in enlarged fashion the upper half of the combustion apparatus of FIG. 1.

As shown by way of example at FIG. 2, thermal fuse 12 of the present embodiment comprises a cord- or thread-like object. This thermal fuse 12 is ablated when heat of a prescribed temperature corresponding to the temperature of the combustion exhaust that flows within the heat exchanger casing 41 or higher impinges thereon, causing its state to change from electrical continuity to electrical open, this serving as trigger for operations for carrying out overheating prevention processing. Instead of or in addition to cord-like thermal fuse 12, overheating prevention device(s) may comprise detector(s), arranged with appropriate spacing therebetween, for outputting signal(s) serving as trigger(s) when heat of prescribed temperature(s) or higher is detected. In the present embodiment, the aforementioned attachment tabs 94, 82 and fastener members 11 cause cord-like thermal fuse 12 to be arranged such that it extends so as to surround heat exchanger casing 41 at a location toward the bottom of heat exchanger casing 41, the two ends thereof being connected to controller (see FIG. 2) 13. In particular, at the back side of heat exchanger casing 41, thermal fuse 12 is arranged so as to extend along a region near the protruding end edge of back flange 9 (e.g., see FIG. 4). In addition, when heat of a prescribed temperature or higher impinges on thermal fuse 12 and is ablated thereby, causing interruption of electrical continuity, controller 13 detects this and forces termination of combustion. For example, supply of electricity to a solenoid-operated gas valve for supply of gas to combustion burner(s) 52 might be interrupted, causing the valve to go from its open state to its closed state, to force termination of combustion.

In accordance with the foregoing embodiment, in the event that there is damage causing puncture of wall(s) surrounding heat exchanger casing 41, as a result of which there is leakage of combustion exhaust from the interior, such leaking combustion exhaust will not be affected by flow of air or the like within outer casing 2 (e.g., flow due to suction of air by blower fan 6), which is to say that such leaking combustion exhaust will not spread, but such leaking combustion exhaust will instead fill the interspace region above the joint with combustor casing 51. In particular, because the region at the back side of heat exchanger casing 41 is partitioned into upper and lower portions by back flange 9 at a location toward the bottom, and is moreover partitioned into upper and lower portions by back flange 10 at a location toward the top, leaking combustion exhaust will fill the space S1' (e.g., see FIG. 3 and FIG. 4) produced by the partitioning above and below by the two back flanges 9, 10. This being the case, the heat from leaking combustion exhaust is able to act in efficient and effective fashion on thermal fuse 12 which extends within this space S1', as a result of which the aforementioned trigger can be output quickly. Also, because thermal fuse 12 within space S1' is arranged at a location toward the protruding end edge of back flange 9, i.e., at a location nearer to installation wall W, the aforementioned trigger can be properly output before installation wall W would experience an overheated condition due to heat from leaking combustion exhaust, as a result of which it will be possible to achieve definitive protection of installation wall W.

Figure 4:
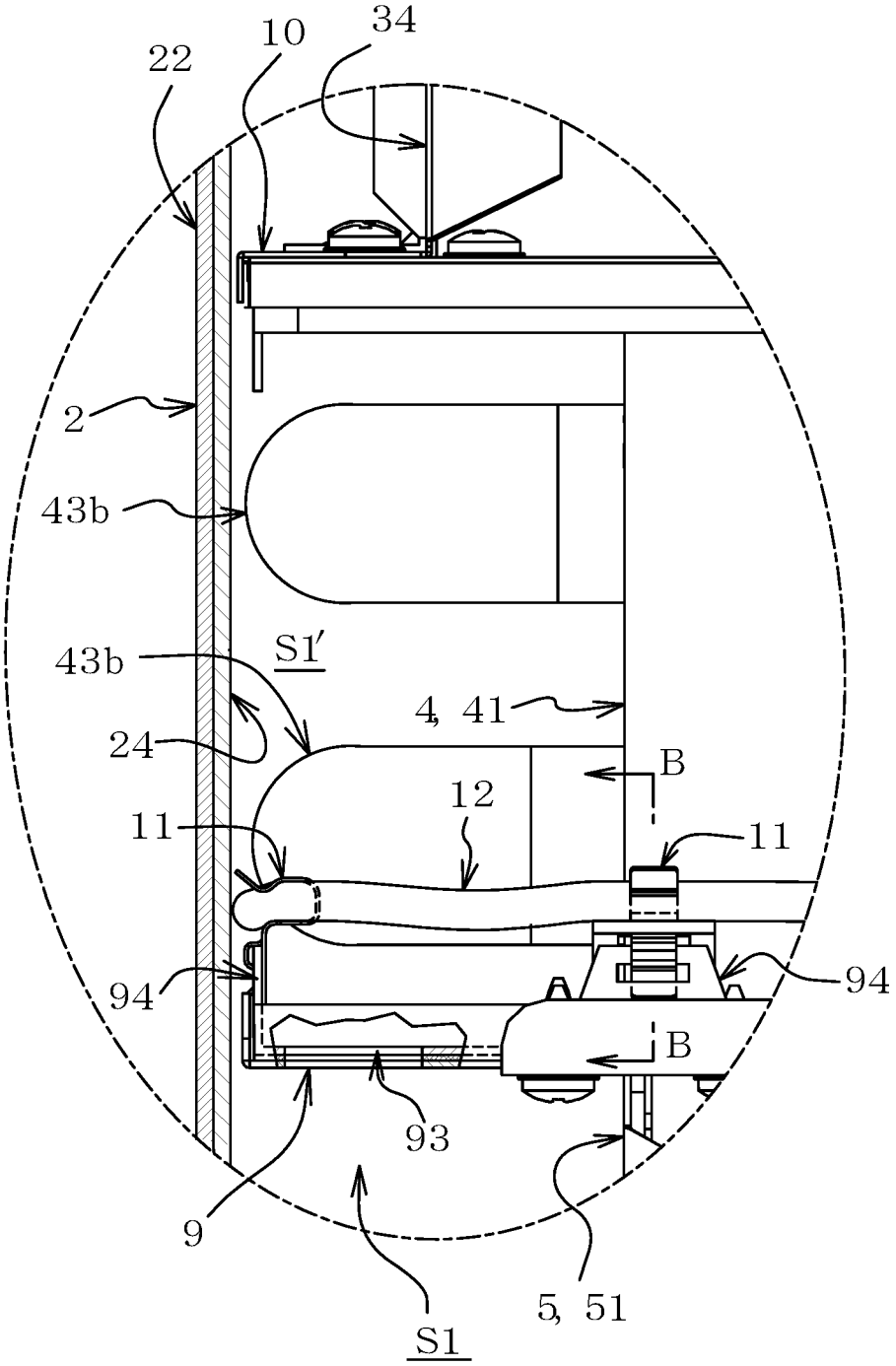
FIG. 4 is an enlarged view of region A in FIG. 3.
Figure 5:
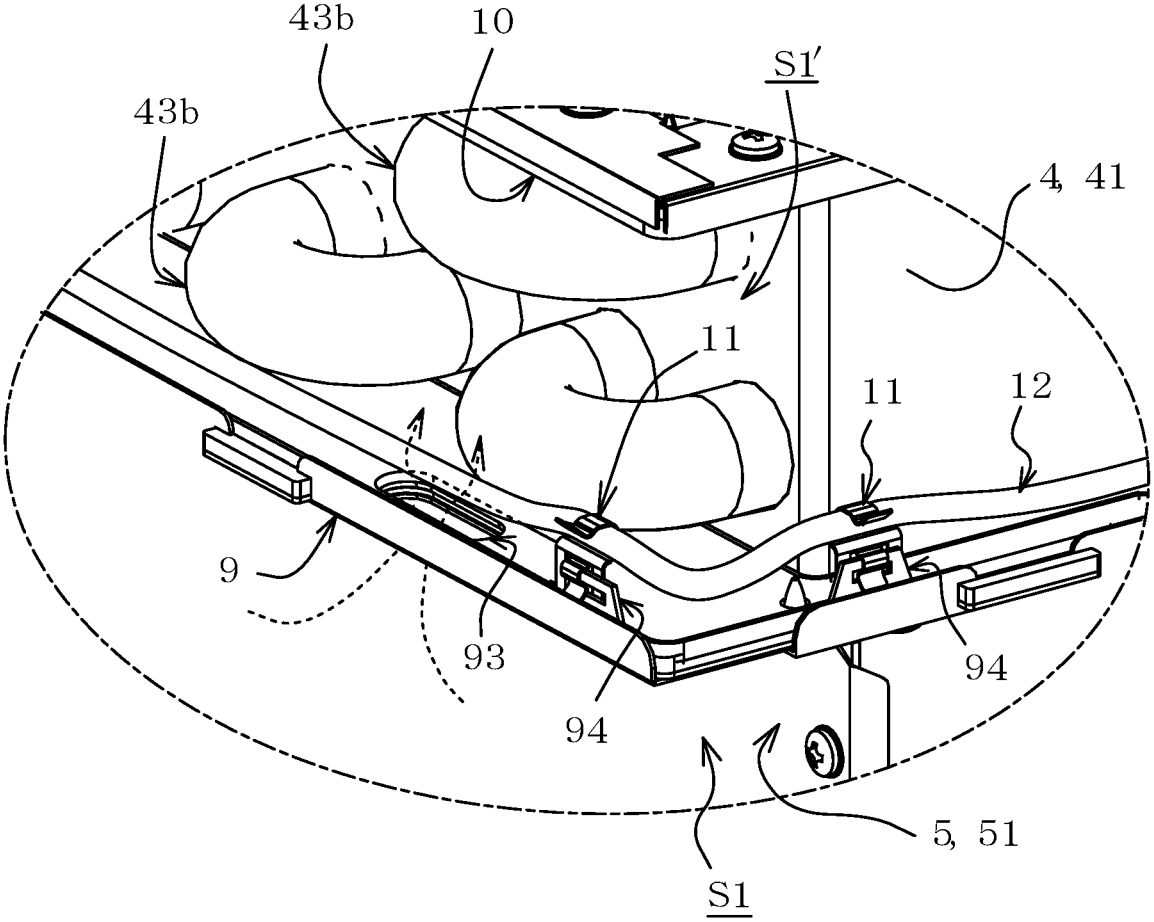
FIG. 5 is a partial perspective view showing the combustion apparatus of FIG. 2 as seen at an oblique angle from behind.

Furthermore, even if the aforementioned damage causing puncture were to occur at combustor casing 51 such that there is occurrence of leakage of the combustion exhaust and/or combustion gas therewithin, such leaking combustion exhaust would be almost completely unaffected by the aforementioned flow of air or the like within outer casing 2, but would rise within interspace region S1 and flow into the aforementioned space S1' by way of through hole(s) 93 (e.g., see FIG. 4 and FIG. 5). As a result, the heat from leaking combustion exhaust will be able to act in efficient and effective fashion on thermal fuse 12, permitting the aforementioned trigger for overheating prevention operations to be output quickly.

Figure 8:
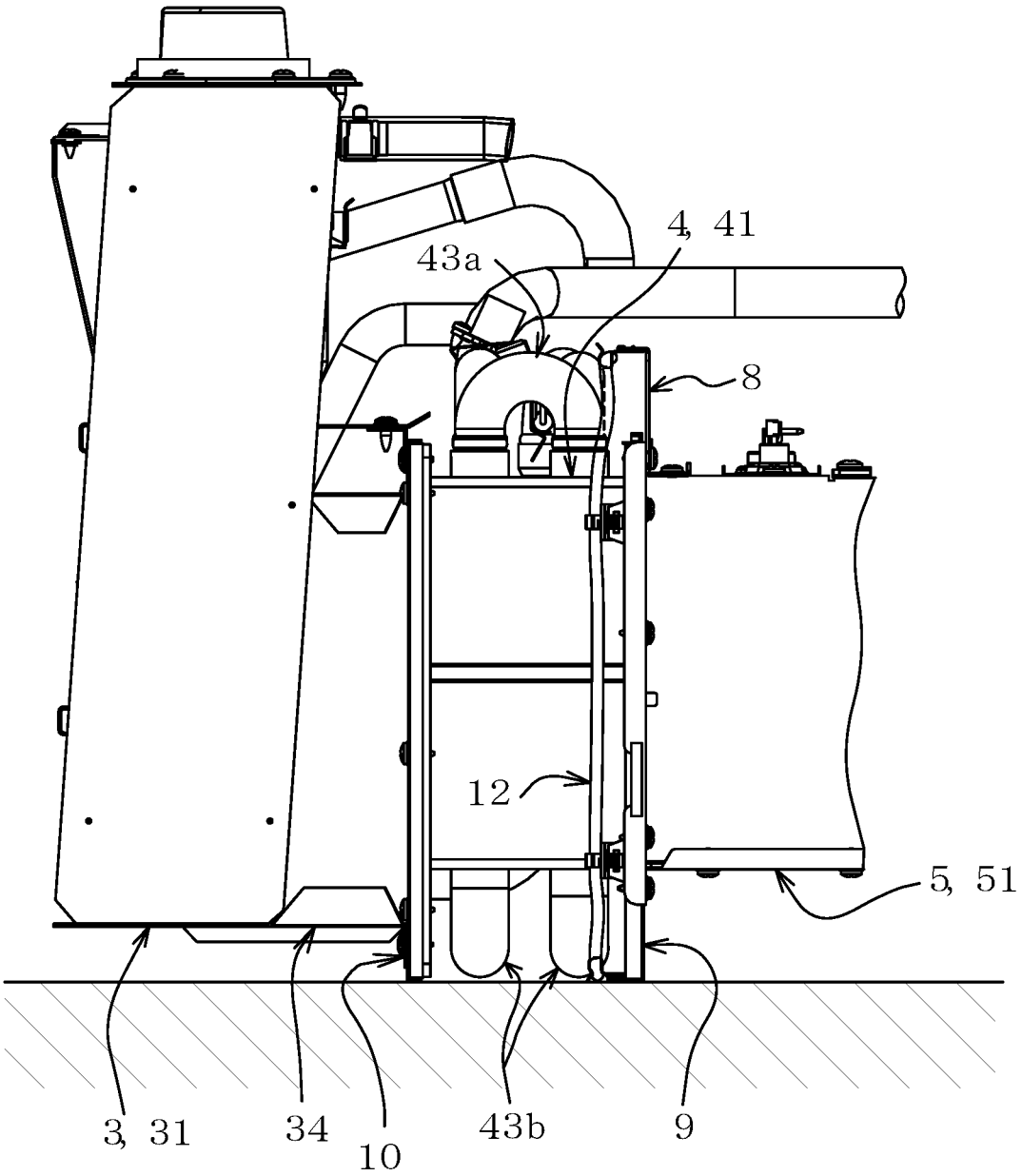
FIG. 8 is a side view from which some portions have been omitted, this side view showing the situation that exists during manufacture of a combustion apparatus when the combustor casing thereof has temporarily been made to lie on its side.

Moreover, as a result of provision of not only lower back flange 9 but also upper back flange 10, space S1' at the back side of heat exchanger casing 41 can be partitioned both above and below, as a result of which not only can leaking combustion exhaust be stopped from spreading and operation of thermal fuse 12 be made to occur in definitive fashion but it will also be possible to obtain actions and effects such as the following. That is, the region into which tubing elbow(s) 43*b* protrude behind heat exchanger casing 41 assumes an enclosed state due to presence thereabove and therebelow of the two back flanges 9, 10 that are made to protrude thereinto by lengths longer than the length(s) by which tubing elbow(s) 43*b* protrude thereinto. For this reason, during manufacture of the combustion apparatus for example as shown in FIG. 8, even if the assembly on which combustor 5, primary heat exchanger 4, and secondary heat exchanger 3 have been installed is temporarily made to lie on its side, it will be possible to prevent occurrence of damage to tubing elbow(s) 43*b*, and it will be possible to prevent occurrence of breakage of primary heat exchanger 4.

Moreover, at space S2 at the front side (e.g., see FIG. 3) as well, presence of front flange 8 makes it possible to reduce the width of the space that would otherwise be wider. This being the case, even if damage causing puncture of the front wall of heat exchanger casing 41 occurs and there is leakage of combustion exhaust from the interior, it will be possible to suppress the spreading of such leaking combustion exhaust and to cause heat to act on thermal fuse 12 in effective fashion.

The present invention is not limited to the foregoing embodiments or the attached drawings but encompasses a wide variety of embodiments in addition thereto. For example, whereas the foregoing embodiment was equipped with an upper back flange 10, it is possible for this to be omitted. While this will impair the closure-producing characteristics of space S1' by a corresponding degree, presence of the lower back flange 9 will make it possible to cause heat from combustion exhaust which leaks from heat exchanger casing 41 to adequately act on thermal fuse 12 and cause occurrence of overheating prevention operations.

Furthermore, whereas the foregoing embodiment was described in terms of a combustion apparatus that was provided with a secondary heat exchanger 3, the present invention is not limited thereto, it being possible to apply the present invention, and it being possible to obtain the operation and effect of the present invention as a result of application thereof, to a situation in which there is no secondary heat exchanger, the combustion apparatus being provided only with heat exchanger(s) in the form of primary heat exchanger(s) 4. Moreover, where the object of the protection produced by overheating prevention device(s) is the installation wall W at which the combustion apparatus is installed, it will be possible to provide back flange 9 and to omit front flange 8.

The invention claimed is:

1. A combustion apparatus comprising:

an outer casing having a rear wall;

an inner casing extending in a vertical direction and constituting a combustor and a heat exchanger unit arranged on upper and lower sides;

a first flange that protrudes so as to be extended toward the rear wall of the outer casing from a back wall of the inner casing at a region in a boundary between the combustor and the heat exchanger unit; and an overheating prevention device that is arranged on the first flange and that is configured so as to operate when heat of a prescribed temperature or higher impinges thereon;

wherein the inner casing is housed within the outer casing;

wherein an inside surface of the rear wall and the back wall of the inner casing are mutually opposed and spaced apart in a front-to-back direction so as to produce an interspace region therebetween;

wherein at least one through hole that penetrates the first flange in the vertical direction is formed in the first flange near the overheating prevention device;

wherein a rearmost edge of the first flange is closer to the rear wall of the outer casing, in the front-to-back direction, than a width of the at least one through hole, in the front-to-rear direction; and wherein the first flange is a physical body that physically partitions and divides the interspace region into an upper space and a lower space to thereby limit airflow between the upper space and the lower space.

2. A combustion apparatus according to claim 1 wherein the overheating prevention device is arranged at a location in a vicinity of a protruding end edge of the first flange.

3. A combustion apparatus according to claim 1 wherein the heat exchanger unit comprises a tubing elbow that protrudes so as to be directed toward the rear wall of the outer casing from the back wall of the inner casing; and wherein the combustion apparatus further comprises a second flange that protrudes, so as to be directed toward the rear wall of the outer casing, from the back wall of the inner casing at a location above the first flange, such that the tubing elbow is straddled by the first flange and the second flange, to a location near the rear wall.

4. A combustion apparatus according to claim 3 wherein a protruding end of the first flange and a protruding end of the second flange protrude so as to extend to locations nearer the rear wall than a protruding end of the tubing elbow.

5. A combustion apparatus according to claim 1 wherein the overheating prevention device is supported in removably attached fashion by the first flange by way of a fastener member.

6. A combustion apparatus according to claim 1 wherein the overheating prevention device comprises a cord-like thermal fuse; and wherein this thermal fuse is arranged about a periphery of the inner casing that constitutes the heat exchanger unit.

7. A combustion apparatus according to claim 6 wherein the thermal fuse is ablated, causing the state thereof to change from electrical continuity to electrical open, when heat of the prescribed temperature or higher impinges thereon.

* * * * *